US007287510B2

(12) United States Patent
Costin et al.

(10) Patent No.: US 7,287,510 B2
(45) Date of Patent: Oct. 30, 2007

(54) SECURED OPERATION OF ELECTRONIC THROTTLE CONTROL (ETC) IN DUAL MODULE SYSTEM

(75) Inventors: Mark H. Costin, Bloomfield Township, MI (US); Paul A. Bauerle, Fenton, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 35 days.

(21) Appl. No.: 11/388,910

(22) Filed: Mar. 24, 2006

(65) Prior Publication Data

US 2007/0221167 A1 Sep. 27, 2007

(51) Int. Cl.
*F02D 9/02* (2006.01)

(52) U.S. Cl. ..... 123/336; 123/396; 123/399

(58) Field of Classification Search ..... 123/336, 123/361, 396, 399
See application file for complete search history.

(56) References Cited

U.S. PATENT DOCUMENTS 6,513,492 B1 * 2/2003 Bauerle et al. ..... 123/496
7,024,305 B2 * 4/2006 Stamm et al. ..... 123/399

* cited by examiner

*Primary Examiner*—T. M. Argenbright

(57) ABSTRACT

An engine control system that regulates first and second throttles of an internal combustion engine includes a primary control module that generates a throttle area based on an operator input and a second control module that determines a second throttle position based on the throttle area. The second control module determines a redundant throttle position based on the throttle area and regulates a position of the second throttle based on the second throttle position if the second throttle position and the redundant throttle position correspond with one another.

21 Claims, 3 Drawing Sheets

SECURED OPERATION OF ELECTRONIC THROTTLE CONTROL (ETC) IN DUAL MODULE SYSTEM

FIELD OF THE INVENTION

The present invention relates to engine control systems, and more particularly to secure electronic throttle control (ETC) in a dual control module system.

BACKGROUND OF THE INVENTION

Internal combustion engines combust a fuel and air mixture within cylinders driving pistons to produce drive torque. In some configurations, the engine includes first and second cylinder banks each including a plurality of cylinders. First and second throttles are respectively associated with the first and second cylinder banks and regulate air flow thereto. A dual control module control system regulates operation of the first and second throttles. More specifically, a primary control module regulates operation of the first throttle and a secondary control module regulates operation of the second throttle.

In traditional single control module control systems, throttle security (i.e., checking the integrity of the throttle position signal) is performed by a cross-check of accelerator pedal position versus a desired throttle position. The cross-check is performed by a watch-dog processor resident in the single control module. This security procedure is impractical to perform in the individual control modules of the dual control module control system because the accelerator pedal position and other vehicle operating parameters (e.g., cruise control, displacement on demand (DOD), drag) must be communicated to both control modules in a coordinated manner.

SUMMARY OF THE INVENTION

Accordingly, the present invention provides an engine control system that regulates first and second throttles of an internal combustion engine. The engine control system includes a primary control module that generates a throttle area based on an operator input and a second control module that determines a second throttle position based on the throttle area. The second control module determines a redundant throttle position based on the throttle area and regulates a position of the second throttle based on the second throttle position if the second throttle position and the redundant throttle position correspond with one another.

In one feature, the second throttle position and the redundant throttle position correspond with one another if a difference therebetween is less than a threshold difference.

In another feature, the second throttle position and the redundant throttle position are further determined based on a coking adjustment.

In other features, the engine control system further includes a pedal position sensor that generates a pedal position signal based on the operator input. The primary control module determines the throttle area based on the pedal position signal. The primary control module determines a first throttle position based on the throttle area and regulates a position of the first throttle based on the first throttle position if the second throttle position and the redundant throttle position correspond with one another.

In still other features, the primary control module transmits the throttle area and a timestamp to the secondary control module and the second control module transmits a corresponding throttle area and a corresponding timestamp based on the throttle area and the timestamp to the primary control module. The primary control module determines whether the throttle area and the timestamp are consistent with the corresponding throttle area and corresponding timestamp and generates a fault if the throttle area and the timestamp are not consistent with the corresponding throttle area and corresponding timestamp.

In yet another feature, the second control module generates a fault if the second throttle position and the redundant throttle position do not correspond with one another and initiates a remedial action when the fault is present.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
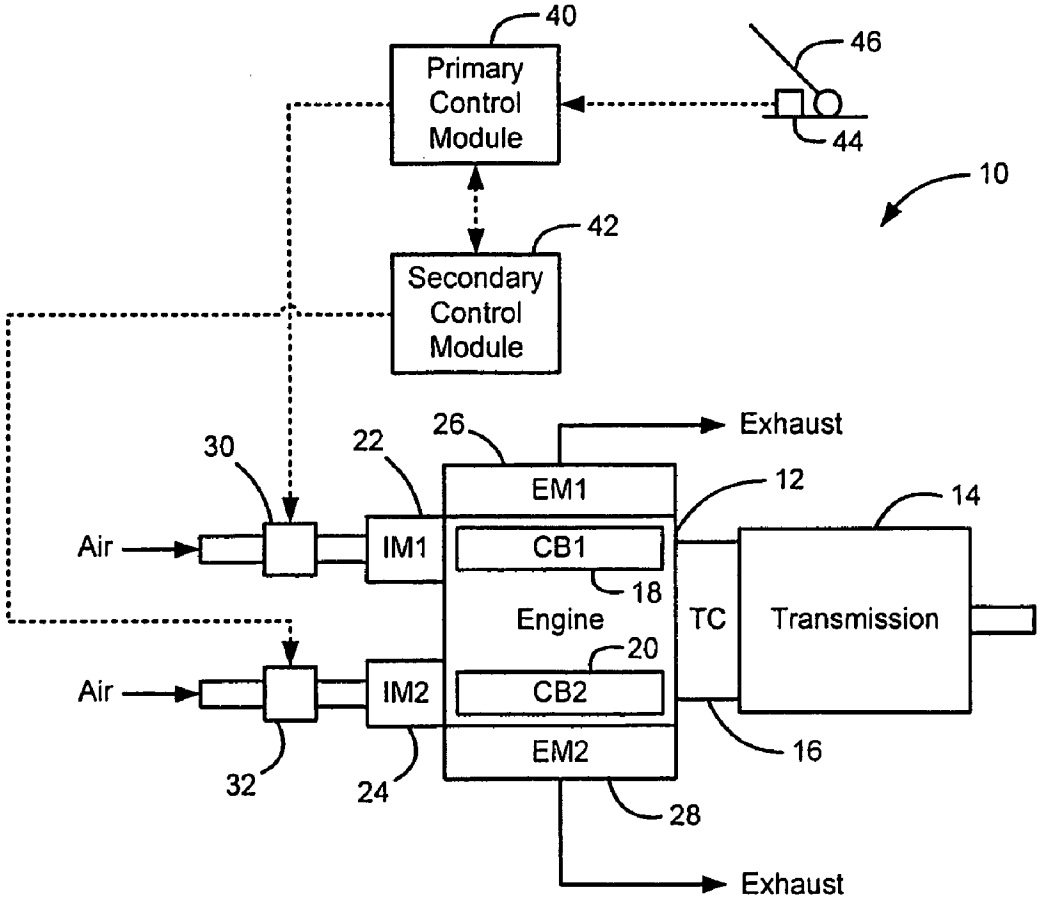
FIG. 1 is a schematic illustration of an exemplary engine system including dual control modules that regulate operation of the engine system based on the of the throttle position control of the present invention.

The following description of the preferred embodiment is merely exemplary in nature and is in no way intended to limit the invention, its application, or uses. For purposes of clarity, the same reference numbers will be used in the drawings to identify similar elements. As used herein, the term module refers to an application specific integrated circuit (ASIC), an electronic circuit, a processor (shared, dedicated, or group) and memory that execute one or more software or firmware programs, a combinational logic circuit, and/or other suitable components that provide the described functionality.

Referring now to FIG. 1, an exemplary vehicle system 10 is schematically illustrated. The vehicle system includes an engine 12 that combusts a fuel and air mixture within cylinders (not shown) to drive pistons slidably disposed within the cylinders. The pistons drive a crankshaft (not shown) to produce drive torque that drives a transmission 14 through a coupling device 16.

The engine 12 includes first and second cylinder banks 18,20 and corresponding first and second intake manifolds 22,24 and first and second exhaust manifolds 26,28. Air is drawn into the first intake manifold 22 through a first throttle 30 and is distributed to the cylinders of the first cylinder bank 18. The air is mixed with fuel, the air/fuel mixture is combusted within the cylinders and exhaust generated by the combustion process is exhausted from the first cylinder bank 18 through the first exhaust manifold 26. Similarly, air is drawn into the second intake manifold 24 through a second throttle 32 and is distributed to the cylinders of the second cylinder bank 20. The air is mixed with fuel, the air/fuel mixture is combusted within the cylinders and exhaust generated by the combustion process is exhausted from the second cylinder bank 20 through the second exhaust manifold 28. The exhaust from the first and second exhaust manifolds 26,28 is treated in an after-treatment or exhaust system (not shown).

The vehicle system 10 further includes a primary control module (PCM) 40 and a secondary control module (SCM) 42 that respectively regulate the first and second throttles 30,32 based on the throttle position control of the present invention. More specifically, the PCM 40 determines a throttle area ($A_{THR}$) based on a driver input. For example, the driver input can include a pedal position that is generated by a pedal position sensor 44 that is responsive to the position of an accelerator input 46. The PCM 40 determines a first throttle position ($P_{THR1}$) and transmits the $A_{THR}$ to the SCM 42. The SCM 42 generates a second throttle position ($P_{THR2}$) and a redundant throttle position ($P_{THR2'}$) based on $A_{THR}$. If $P_{THR2}$ and $P_{THR2'}$ correspond with one another, the PCM 40 regulates operation of the first throttle 30 based on $P_{THR1}$ and the SCM 42 regulates operation of the second throttle 32 based on $P_{THR2}$. If $P_{THR2}$ and $P_{THR2'}$ do not correspond with one another, a fault is signaled and remedial action (e.g., engine shutdown) is taken.

Figure 2:
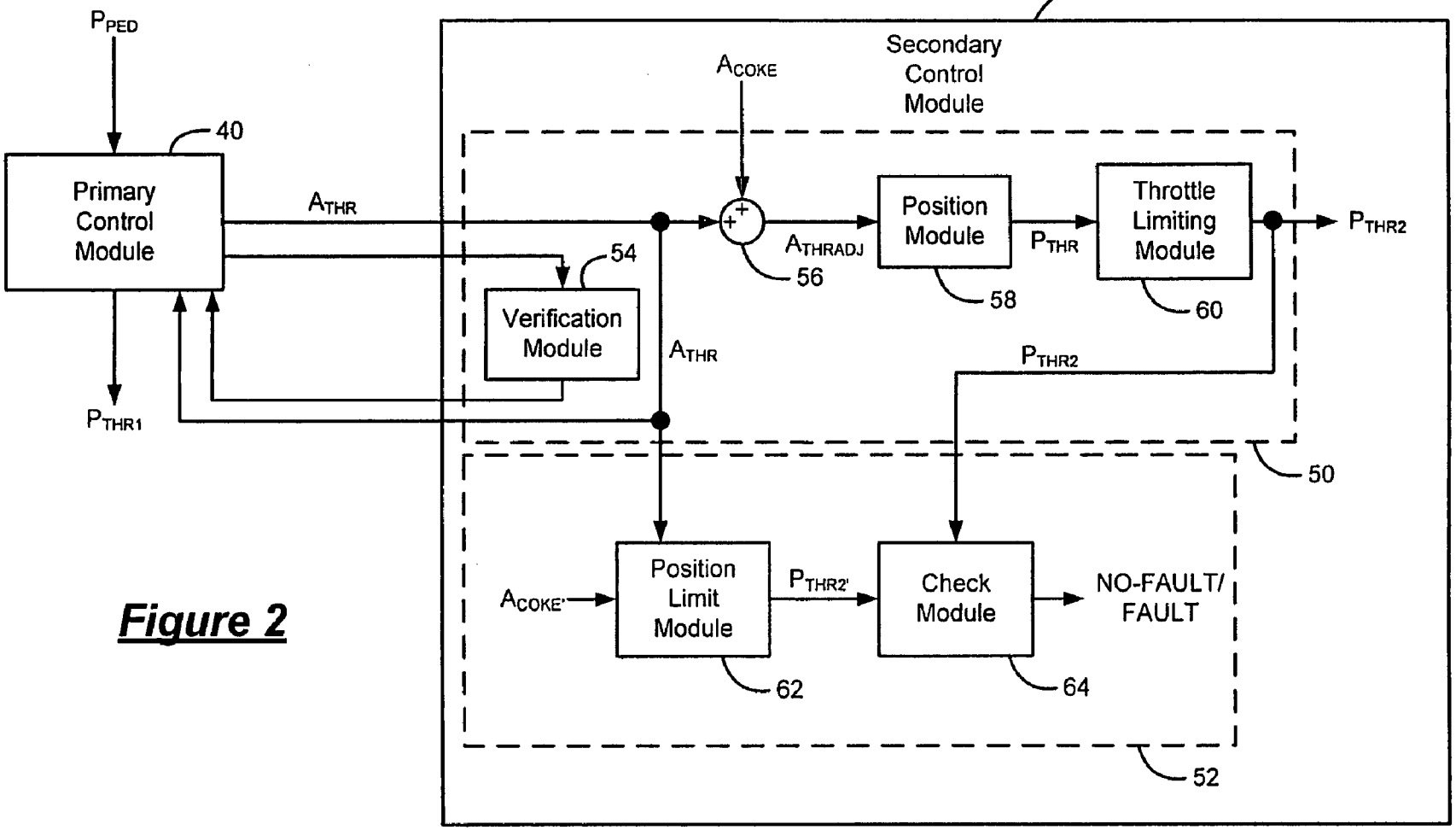
FIG. 2 is a signal flow diagram illustrating exemplary primary and secondary control modules that execute the throttle position control of the present invention.

Referring now to FIG. 2, the SCM 42 includes a first sub-module 50 (e.g., a MAIN sub-module) and a second sub-module 52 (e.g., a MAIN health co-processor (MHC) sub-module). As explained in further detail below, the second sub-module 52 provides a security path to monitor the output of the first sub-module 50. The first sub-module 50 includes a verification module 54, a summer 56, a position module 58 and a throttle limiting module 60. The second sub-module 52 includes a position limit module 62 and a check module 64.

The SCM 42 receives $A_{THR}$ and a corresponding time stamp from the PCM 40. The verification module 54 verifies incrementing of the time stamp. $A_{THR}$ and the corresponding timestamp are transmitted back to the PCM 40, which verifies that the $A_{THR}$ and the timestamp indeed correspond. The summer 56 receives $A_{THR}$ and a throttle area coking compensation value ($A_{COKE}$). $A_{COKE}$ is a long-term learned value that accounts for deposit build-up in the throttle bore, as described in further detail in U.S. patent application Ser. No. 10/689,184, filed on Oct. 20, 2003 now U.S. Pat. No. 7,024,305 and entitled Air Flow Variation Learning Using Electronic Throttle Control, the disclosure of which is expressly incorporated herein by reference. The summer 56 determines an adjusted throttle area ($A_{THRADJ}$) based on $A_{THR}$ and $A_{COKE}$.

The position module 58 determines a throttle position ($P_{THR}$) based on $A_{THRADJ}$. More specifically, the position module 58 includes a resident look-up table to determine $P_{THR}$ based on $A_{THRADJ}$. The throttle limiting module 60 determines $P_{THR2}$ based on $P_{THR}$. More specifically, the throttle limiting module 60 limits the rate of change of the throttle position based on previous throttle positions and engine operating conditions. In this manner, the change in throttle position occurs at a manageable rate.

The position limit module 62 determines a parallel second throttle position ($P_{THR2'}$) based on ATHR and a parallel throttle area coking compensation value ($A_{COKE'}$). More specifically, the position limit module 62 determines $P_{THR2'}$ concurrent with $P_{THR2}$ in the first sub-module 50. $A_{COKE'}$ is determined separately but concurrent to $A_{COKE}$. The check module 64 determines a second throttle position difference ($\Delta_{POS}$) based on $P_{THR2}$ and $P_{THR2'}$. More specifically, $\Delta_{POS}$ is determined as the difference between $P_{THR2}$ and $P_{THR2'}$.

The check module 64 compares $\Delta_{POS}$ to a threshold difference ($\Delta_{THR}$). If $\Delta_{POS}$ is not greater than $\Delta_{THR}$, $P_{THR2}$ and $P_{THR2'}$ sufficiently correlate and a no-fault signal is generated. When the no-fault signal is generated, the PCM 40 regulates the first throttle 30 based on $P_{THR1}$ and the SCM 42 regulates the second throttle 32 based on $P_{THR2}$. If $\Delta_{POS}$ is greater than $\Delta_{THR}$, $P_{THR2}$ and $P_{THR2'}$ vary from one another by an unacceptable amount and a fault signal is generated. When the fault signal is generated, remedial action is initiated. Exemplary remedial actions include, but are not limited to, engine shut-down or entering a limp-home mode that provides limited engine operation.

Alternative module arrangements and communication links are also anticipated. In an exemplary alternative, PCM 40 sends two copies of $A_{THR}$, without coking, to the SCM 42. One copy of $A_{THR}$ is processed in the first sub-module 50 and the other copy is processed in the second sub-module 52.

Figure 3:
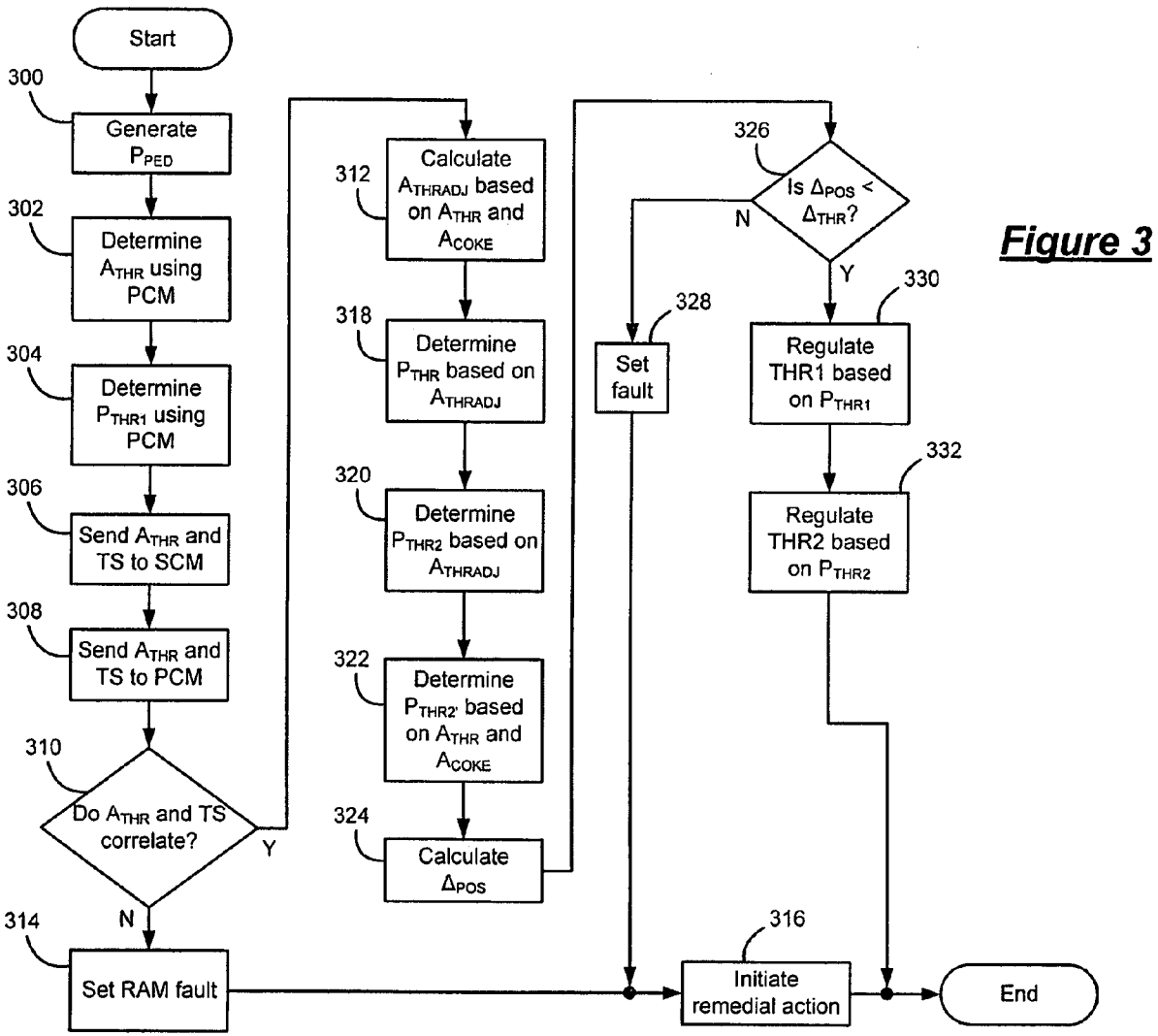
FIG. 3 is a flowchart illustrating exemplary steps executed by the throttle position control of the present invention.

Referring now to FIG. 3, exemplary steps executed by the throttle position control will be discussed in detail. In step 300, control generates $P_{PED}$ based on the driver input. Control determines $A_{THR}$ using the PCM 40 in step 302. In step 304, control determines $P_{THR1}$ using the PCM. Control sends ATHR and the corresponding timestamp (TS) to the SCM 42 in step 306. In step 308, control sends $A_{THR}$ and TS back to the PCM. In step 310, control determines whether $A_{THR}$ and TS correlate. If $A_{THR}$ and TS do correlate, control continues in step 312. If $A_{THR}$ and TS do not correlate, control sets a RAM fault in step 314 and continues in step 316.

In step 312, control calculates $A_{THRADJ}$ based on $A_{THR}$ and $A_{COKE}$. Control determines $P_{THR}$ based on $A_{THRADJ}$ in step 318. In step 320, control rate limits $P_{THR}$ and engine operating conditions to provide $P_{THR2}$. Control determines $P_{THR2'}$ based on $A_{THR}$ and $A_{COKE'}$ using the second sub-module 52 in step 322. In step 324, control calculates $\Delta_{POS}$ based on $P_{THR2}$ and $P_{THR2'}$.

Control determines whether $\Delta_{POS}$ is greater than $\Delta_{THR}$ in step 326. If $\Delta_{POS}$ is greater than $\Delta_{THR}$, control sets a fault in step 328 and continues in step 316. If $\Delta_{POS}$ is not greater than $\Delta_{THR}$, control regulates the first throttle 30 based on $P_{THR1}$ in step 330. In step 332, control regulates the second throttle 32 based on $P_{THR2}$ and control ends. In step 316, control initiates remedial action (e.g., engine shut-down) and control ends.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. An engine control system that regulates first and second throttles of an internal combustion engine, comprising:

a primary control module that generates a throttle area based on an operator input; and a second control module that determines a second throttle position using a secondary control module based on said throttle area, that determines a redundant throttle position based on said throttle area and that regulates a position of said second throttle based on said second throttle position if said second throttle position and said redundant throttle position correspond with one another.

2. The engine control system of claim 1 wherein said second throttle position and said redundant throttle position correspond with one another if a difference therebetween is less than a threshold difference.

3. The engine control system of claim 1 wherein said second throttle position and said redundant throttle position are further determined based on a coking adjustment.

4. The engine control system of claim 1 further comprising a pedal position sensor that generates a pedal position signal based on said operator input, wherein said primary control module determines said throttle area based on said pedal position signal.

5. The engine control system of claim 4 wherein said primary control module determines a first throttle position based on said throttle area and regulates a position of said first throttle based on said first throttle position if said second throttle position and said redundant throttle position correspond with one another.

6. The engine control system of claim 1 wherein said primary control module transmits said throttle area and a timestamp to said secondary control module and wherein said second control module transmits a corresponding throttle area and a corresponding timestamp based on said throttle area and said timestamp to said primary control module.

7. The engine control system of claim 6 wherein said primary control module determines whether said throttle area and said timestamp are consistent with said corresponding throttle area and corresponding timestamp and generates a fault if said throttle area and said timestamp are not consistent with said corresponding throttle area and corresponding timestamp.

8. The engine control system of claim 1 wherein said second control module generates a fault if said second throttle position and said redundant throttle position do not correspond with one another and initiates a remedial action when said fault is present.

9. A method of regulating throttle positions of first and second throttles of an internal combustion engine, comprising:

determining a second throttle position using a secondary control module based on a throttle area determined using a primary control module;

determining a redundant throttle position using said secondary control module based on said throttle area; and regulating a position of said second throttle based on said second throttle position if said second throttle position and said redundant throttle position correspond with one another.

10. The method of claim 9 wherein said second throttle position and said redundant throttle position correspond with one another if a difference therebetween is less than a threshold difference.

11. The method of claim 9 wherein said second throttle position and said redundant throttle position are further determined based on a coking adjustment.

12. The method of claim 9 further comprising:

generating a pedal position signal based on an operator input;

determining said throttle area based on said pedal position signal in said primary control module.

13. The method of claim 12 further comprising:

determining a first throttle position based on said throttle area using said primary control module;

regulating a position of said first throttle based on said first throttle position if said second throttle position and said redundant throttle position correspond with one another.

14. The method of claim 9 further comprising:

transmitting said throttle area and a timestamp from said primary control module to said secondary control module;

transmitting a corresponding throttle area and a corresponding timestamp based on said throttle area and said timestamp from said secondary control module back to said primary control module;

determining whether said throttle area and said timestamp are associated with said corresponding throttle area and corresponding timestamp; and generating a fault if said throttle area and said timestamp are not associated with said corresponding throttle area and corresponding timestamp.

15. The method of claim 9 further comprising:

generating a fault if said second throttle position and said redundant throttle position do not correspond with one another; and performing a remedial action when said fault is present.

16. A method of securely regulating operation of an electronic throttle control in a dual control module system for an internal combustion engine, comprising:

generating a driver input signal;

calculating a throttle area using a primary control module of said dual control module system;

determining a second throttle position using a secondary control module of said dual control module system based on said throttle area;

determining a redundant throttle position using said secondary control module based on said throttle area; and regulating a position of a first throttle based on a first throttle position and a second throttle based on said second throttle position if said second throttle position and said redundant throttle position correspond with one another.

17. The method of claim 16 wherein said second throttle position and said redundant throttle position correspond with one another if a difference therebetween is less than a threshold difference.

18. The method of claim 16 wherein said second throttle position and said redundant throttle position are further determined based on a coking adjustment.

19. The method of claim 9 wherein said driver input signal is generates based on an accelerator pedal position.

20. The method of claim 16 further comprising:

transmitting said throttle area and a timestamp from said primary control module to said secondary control module;

transmitting a corresponding throttle area and a corresponding timestamp based on said throttle area and said timestamp from said secondary control module back to said primary control module;

determining whether said throttle area and said timestamp are associated with said corresponding throttle area and corresponding timestamp; and generating a fault if said throttle area and said timestamp are not associated with said corresponding throttle area and corresponding timestamp.

21. The method of claim 16 further comprising:

generating a fault if said second throttle position and said redundant throttle position do not correspond with one another; and performing a remedial action when said fault is present.

* * * * *